US007600526B2

(12) United States Patent
Williams et al.

(10) Patent No.: US 7,600,526 B2
(45) Date of Patent: Oct. 13, 2009

(54) METHODS AND APPARATUS FOR OPERATING STEAM TURBINES

(75) Inventors: Raymond Billy Williams, Sterling, MA (US); Wingming Oliver Chow, Acton, MA (US); Robert Alan Cerrone, Westford, MA (US); Kenneth John Hultgren, Leominster, MA (US)

(73) Assignee: General Electric Company, Schenectady, NY (US)

( * ) Notice: Subject to any disclaimer, the term of this patent is extended or adjusted under 35 U.S.C. 154(b) by 627 days.

(21) Appl. No.: 11/489,863

(22) Filed: Jul. 20, 2006

(65) Prior Publication Data

US 2008/0017251 A1 Jan. 24, 2008

(51) Int. Cl.
*F01D 25/32* (2006.01)

(52) U.S. Cl. ..... 137/15.04; 137/314; 137/240

(58) Field of Classification Search ..... 137/314, 137/312, 240, 241, 15.04, 15.05
See application file for complete search history.

(56) References Cited

U.S. PATENT DOCUMENTS

| | | | | |
|---|---|---|---|---|
| 179,863 | A * | 7/1876 | Moritz | 137/177 |
| 4,893,467 | A | 1/1990 | Woodson | |
| 4,969,324 | A | 11/1990 | Woodson | |
| 5,540,045 | A | 7/1996 | Corbett et al. | |
| 6,098,645 | A * | 8/2000 | Brackelmann et al. | 137/15.01 |
| 6,907,892 | B2 * | 6/2005 | Sugano | 134/94.1 |
| 7,489,253 | B2 * | 2/2009 | Murphy | 340/605 |

* cited by examiner

*Primary Examiner*—Kevin L Lee
(74) *Attorney, Agent, or Firm*—Armstrong Teasdale LLP

(57) ABSTRACT

A drain purge system for a casing is provided. The purge system includes a purge chamber. The purge chamber is defined by a purge chamber bulkhead. The purge chamber is further defined by a purge chamber drain portion including a drain aperture. The purge chamber bulkhead is coupled to an exterior surface of the casing. The exterior surface includes a drain orifice therethrough. The purge chamber bulkhead circumscribes the drain orifice. The purge system further includes a purge fluid source in flow communication with the purge chamber. The purge fluid source is configured to supply the purge chamber with a flow of purge fluid.

20 Claims, 2 Drawing Sheets

METHODS AND APPARATUS FOR OPERATING STEAM TURBINES

BACKGROUND OF THE INVENTION

This invention relates generally to steam turbines and more particularly to drain purge systems for steam turbines.

At least some known steam turbines include a casing comprising an upper half shell and a lower half shell formed together at a joint. The joined half shells make up a casing that surrounds the rotating member of the turbine. During operation, condensed water may collect in the lower half shell. The water is removed using drain orifices formed in the lower half of the shell. Moisture collected in the lower half shell is routed to the drain orifices. During extended periods of operation, the drain orifices can become clogged from dirt, scale or chemical deposits. Clogged orifices cause excessive moisture to remain in the steam path. Excessive moisture tends to increase erosion of components within the steam path.

In some known steam turbines, the deposits collected in the drain orifices are removed from the drain orifices by shutting down and disassembling the steam turbine. Therefore, the drain orifices are only accessible for cleaning during a major maintenance outage.

BRIEF DESCRIPTION OF THE INVENTION

In one aspect, a drain purge system for a casing is provided. The purge system includes a purge chamber. The purge chamber is defined by a purge chamber bulkhead. The purge chamber is further defined by a purge chamber drain portion including a drain aperture. The purge chamber bulkhead is coupled to an exterior surface of the casing. The exterior surface includes at least one drain orifice therethrough. The purge chamber bulkhead circumscribes the drain orifice. The purge system further includes a purge fluid source in flow communication with the purge chamber. The purge fluid source is configured to supply the purge chamber with a flow of purge fluid.

In a further aspect, a method of operating a drain purge system is provided. The method includes receiving drain flow from a drain orifice into a purge chamber in flow communication with the drain orifice, draining the purge chamber through an aperture, supplying a flow of purge fluid to the purge chamber, and generating a reverse flow in the drain orifice using a back pressure determined by the flow of purge fluid and the aperture.

In another aspect, a steam turbine is provided. The steam turbine includes a casing, and a drain purge system configured to purge a drain orifice that drains the casing. The purge system includes a purge chamber coupled to the casing and circumscribing the drain orifice. The purge chamber includes a bulkhead and a purge chamber drain portion coupled to the bulkhead. The purge chamber drain portion includes a drain aperture. The purge system also includes a purge fluid source in flow communication with the purge chamber. The purge fluid source is configured to supply the purge chamber with a flow of purge fluid.

DETAILED DESCRIPTION OF THE INVENTION

Figure 1:
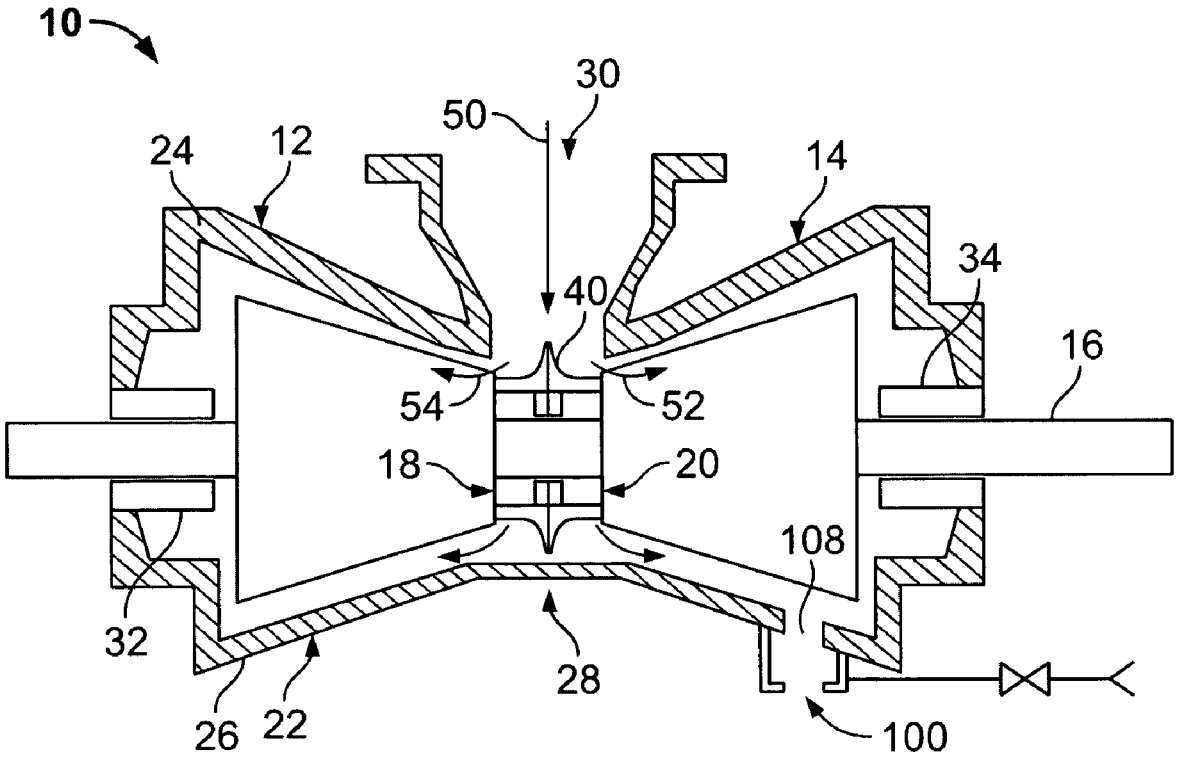
FIG. 1 is a schematic illustration of an exemplary opposed-flow steam turbine.

FIG. 1 is a schematic illustration of an exemplary opposed-flow steam turbine 10. Turbine 10 includes first and second low pressure (LP) sections 12 and 14. As is known in the art, each turbine section 12 and 14 includes a plurality of stages of diaphragms (not shown in FIG. 1). A rotor shaft 16 extends through sections 12 and 14. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

It should be noted that although FIG. 1 illustrates an opposed-flow low pressure turbine, as will be appreciated by one of ordinary skill in the art, the present invention is not limited to being used with low pressure turbines and can be used with any turbine including, but not limited to intermediate pressure (IP) turbines or high pressure (HP) turbines.

During operation, low pressure steam inlet 30 receives low pressure/intermediate temperature steam 50 from a source, for example, an HP turbine or IP turbine through a cross-over pipe (not shown). The steam 50 is channeled through inlet 30 wherein flow splitter 40 splits the steam flow into two opposite flow paths 52 and 54. More specifically, the steam 50 is routed through LP sections 12 and 14 wherein work is extracted from the steam to rotate rotor shaft 16. The steam exits LP sections 12 and 14 and is routed to a condenser, for example. During operation, a casing drain(s) 108 facilitates removing condensed moisture from an interior of casing 22. Over time casing drain 108 may become obstructed by, for example, sediment collecting within casing drain, which inhibits moisture from being removed from the interior of casing 22. In the exemplary embodiment, turbine 10 includes a drain purge system 100 that facilitates clearing an obstructed or partially obstructed casing drain.

Figure 2:
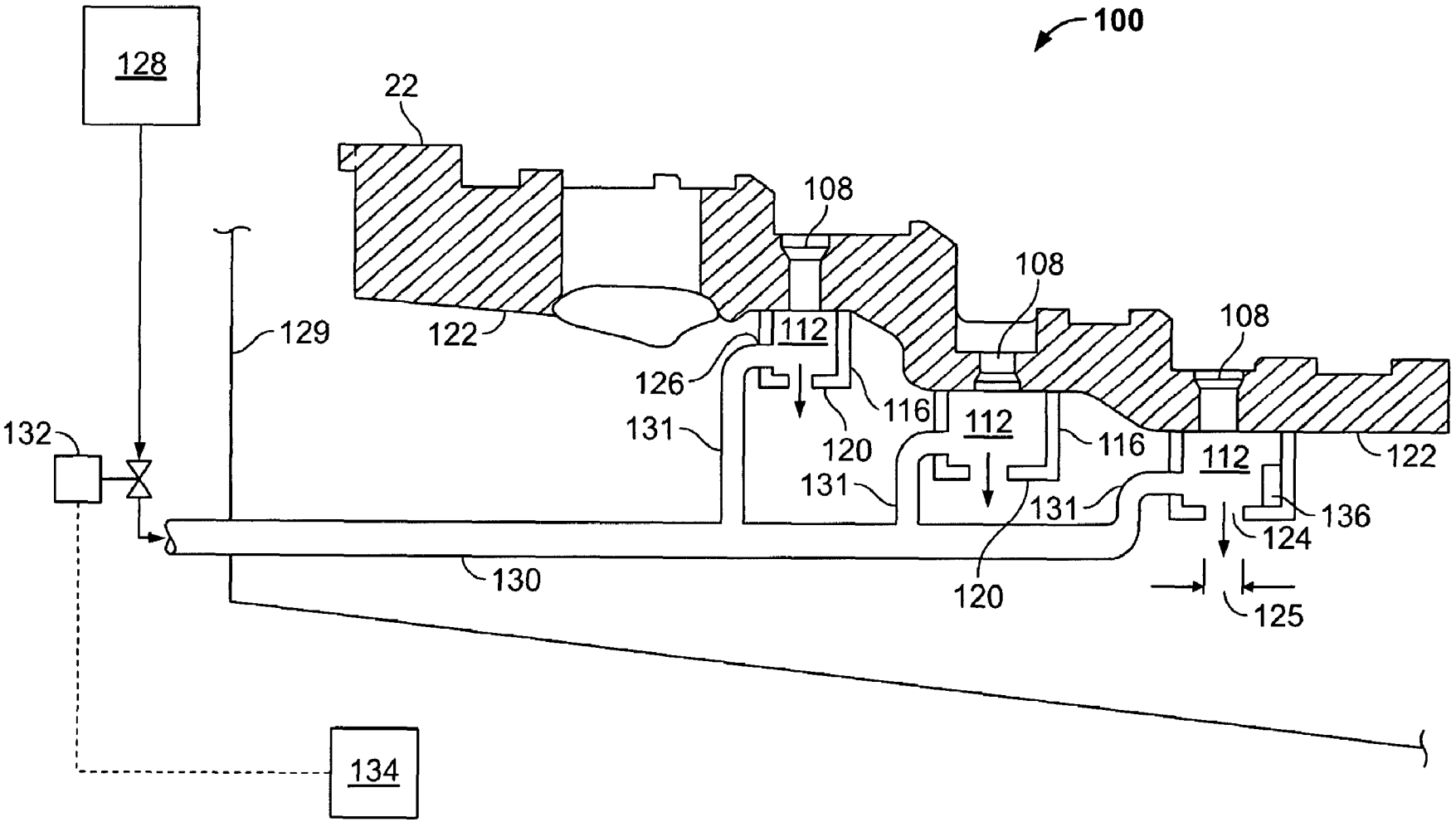
FIG. 2 is a schematic illustration of an exemplary drain purge system that may be used with the steam turbine shown in FIG. 1.

FIG. 2 is a schematic illustration of an exemplary drain purge system 100 that may be used with steam turbine 10. Casing 22 includes at least one drain orifice 108. Drain orifice 108 extends through casing 22, and is configured to drain casing 22 of moisture collected in casing 22 during operation. A drain purge system 100 includes at least one purge chamber 112 such that purge chamber 112 is in flow communication with drain orifice 108. In the exemplary embodiment, casing 22 includes a plurality of drain orifices 108. At least some of the plurality of drain orifices 108 include a respective purge chamber 112. Purge chamber 112 is defined by a purge chamber bulkhead 116 and a purge chamber drain portion 120 coupled to bulkhead 116. Bulkhead 116 is coupled to an exterior surface 122 of casing 22 and circumscribes drain orifice 108. In the exemplary embodiment, bulkheads 116 are cylindrical in shape and include a tee-piping connection 126. Alternatively, bulkheads 116 are formed in a rectangular, pyramidal, hemispherical, or other shape. Alternatively, connection 126 is not a tee-piping connection, but another suitable connection. Additionally, drain portion 120 includes a drain aperture 124. Aperture 124 includes a diameter 125. In the exemplary embodiment, drain aperture 124 is a precision drilled hole.

Drain purge system 100 also includes a purge fluid source 128 in flow communication with purge chamber 112. For example, a purge fluid source is high pressure steam or compressed air. Purge fluid flows from purging fluid source 128 through a steam piping manifold 130 to supply purge chamber 112 with a flow of purge fluid. In the exemplary embodiment, steam piping manifold 130 extends from purge fluid source 128 through an exhaust casing 129 to purge chamber 112. In the exemplary embodiment, exhaust casing 129 is fabricated from carbon steel. Alternatively, exhaust casing 129 is fabricated from other suitable materials. In an alternative embodiment, turbine 10 does not include exhaust casing 129. In the exemplary embodiment, purge fluid source 128 is in flow communication with at least some of respective purge chambers 112. More specifically, steam piping manifold 130 includes individual pipes 131 coupled to individual respective purge chambers 112. In the exemplary embodiment, steam piping manifold 130 is a parallel piping arrangement. Alternatively, steam piping manifold 130 uses a piping arrangement wherein purge chambers 112 are coupled together in serial flow communication. When purge chambers 112 are in serial flow communication, steam piping manifold 130 may require various pipe sizes to facilitate equalizing the purge fluid flow to purge chambers 112 and to reduce head losses. In the exemplary embodiment, steam piping manifold 130 is sized to supply purge fluid to respective purge chambers 112 simultaneously. Alternatively, steam piping manifold 130 is sized to supply purge fluid to respective purge chambers 112 individually. When purge fluid is supplied to respective purge chambers 112 simultaneously, steam piping manifold 130 may be sized larger in diameter than when purge chambers 112 are supplied individually to facilitate accounting for head losses due to increased purge fluid flow to purge chambers 112.

Additionally, drain purge system 100 includes a valve 132 configured to initiate purging and to regulate the flow from purge fluid source 128 to purge chamber 112. In the exemplary embodiment, valve 132 is a manually-operated valve. Alternatively, valve 132 is a powered valve that is operated via a signal transmitted to a valve driver, such as, but not limited to, a solenoid, a pneumatic drive, and/or an electric actuator. For example, in one embodiment, valve 132 is a powered valve that receives a signal to initiate purging from a turbine controller or a plant distributed control system.

In one embodiment, drain purge system 100 also includes a sensor 136 configured to detect drain aperture 124 flow. For example, in one embodiment, sensor 136 is a level sensor that monitors the level of purge fluid flow within purge chamber 112. Alternatively, drain purge system 100 does not include sensor 136.

Generally, during operation of steam turbine 10, purge chamber 112 receives drain flow from drain orifice 108, and purge chamber 112 is drained through aperture 124. During operating of steam turbine 10, valve 132 is opened either automatically or manually to initiate purging of drain purge system 100. When valve 132 is open, purge fluid flows through steam piping manifold 130. Purge fluid then flows into individual pipes 131 and into respective purge chambers 112.

After purge fluid has flowed into purge chamber 112, drain aperture 124 maintains a back pressure in purge chamber 112 sufficient to force a reverse flow of purge fluid through drain orifice 108. The reverse flow through drain orifice 108 clears debris and sediments from drain 108 that have collected in drain orifice 108 during operation of steam turbine 10. Clearing debris from drain orifice 108 prevents excessive moisture from remaining in the steam path.

The above-described drain purge system is a cost-effective and highly efficient method for purging a drain orifice in a steam turbine casing to prevent the drain orifice from becoming clogged with deposits. The deposits that have collected in the drain orifices can be removed without shutting down the steam turbine. Drain orifices without deposits enable the drain orifices to continuously flow moisture thereby eliminating the erosion damage to steam path components caused by excessive moisture in the steam.

While the invention has been described in terms of various specific embodiments, those skilled in the art will recognize that the invention can be practiced with modification within the spirit and scope of the claims.

What is claimed is:

1. A drain purge system for use with a drain system for a casing, said purge system comprising:

a purge chamber defined by a purge chamber bulkhead, said purge chamber further defined by a purge chamber drain portion comprising a drain aperture, said purge chamber bulkhead is coupled to an exterior surface of the casing, said exterior surface including a drain orifice therethrough, said purge chamber bulkhead circumscribing the drain orifice; and a source of purge fluid in flow communication with said purge chamber, said source of purge fluid is configured to supply said purge chamber with a flow of purge fluid.

2. A drain purge system in accordance with claim 1 wherein said drain aperture and said flow of purge fluid are configured to generate a reverse flow of purge fluid through the drain orifice.

3. A drain purge system in accordance with claim 1 wherein said drain aperture has a diameter sized to maintain a back pressure in said purge chamber that is sufficient to force a reverse flow of purge fluid through the drain orifice.

4. A drain purge system in accordance with claim 1 wherein said purge system comprises a plurality of drain orifices.

5. A drain purge system in accordance with claim 1 wherein the casing includes a plurality of drain orifices, said purge system comprises a plurality of purge chambers, each of said plurality of purge chambers coupled in flow communication to at least one of the plurality of drain orifices.

6. A drain purge system in accordance with claim 5 wherein said source of purge fluid is coupled in flow communication with at least one of said plurality of purge chambers.

7. A drain purge system in accordance with claim 6 wherein said source of purge fluid is in flow communication with said plurality of purge chambers via at least one of a parallel flow piping arrangement and a serial flow piping arrangement.

8. A drain purge system in accordance with claim 5 wherein said source of purge fluid is configured to supply purge fluid to at least two of said plurality of purge chambers substantially simultaneously.

9. A drain purge system in accordance with claim 5 wherein said source of purge fluid is configured to supply purge fluid to said plurality of purge chambers individually.

10. A drain purge system in accordance with claim 1 further comprising a valve configured to regulate a flow of purge fluid from said purge fluid source to said purge chamber.

11. A drain purge system in accordance with claim 1 further comprising a sensor configured to detect drain aperture flow.

12. A method of operating a drain purge system, said method comprising the steps of:

receiving drain flow from a drain orifice into a purge chamber coupled in flow communication with the drain orifice;

draining the purge chamber through an aperture;

supplying a flow of purge fluid to the purge chamber; and generating a reverse flow through the drain orifice using a back pressure determined by the flow of purge fluid and the aperture.

13. A method in accordance with claim 12 wherein said step of supplying a flow of purge fluid to the purge chamber comprises maintaining a back pressure in the purge chamber sufficient to force a reverse flow of purge fluid through said drain orifice.

14. A method in accordance with claim 12 wherein said step of draining the purge chamber through an aperture comprises monitoring the amount of reverse flow in the purge chamber.

15. A method in accordance with claim 13 wherein said step of draining the purge chamber through an aperture comprises monitoring the amount of reverse flow in the purge chamber using a level sensor.

16. A method in accordance with claim 12 wherein said step of supplying the purge fluid further comprises using at least one of a manual valve and an automatic valve.

17. A steam turbine comprising:

a casing comprising at least one drain orifice configured to drain fluids from said casing; and a drain purge system configured to purge said casing drain orifice, said purge system comprising:

a purge chamber coupled to said casing and circumscribing said drain orifice, said purge chamber comprising a bulkhead and a purge chamber drain portion coupled to said bulkhead, said purge chamber drain portion comprising a drain aperture; and a purge fluid source coupled in flow communication with said purge chamber, said purge fluid source is configured to supply said purge chamber with a flow of purge fluid.

18. A steam turbine in accordance with claim 17 wherein said drain purge system generates a reverse flow of purge fluid through said at least one drain orifice.

19. A steam turbine in accordance with claim 17 wherein said drain aperture is configured to maintain a back pressure in said purge chamber sufficient to force a reverse flow of purge fluid through said drain orifice.

20. A steam turbine in accordance with claim 17 further comprising a valve configured to regulate flow from said source of purge fluid to said purge chamber.

* * * * *

UNITED STATES PATENT AND TRADEMARK OFFICE

CERTIFICATE OF CORRECTION

PATENT NO. : 7,600,526 B2
APPLICATION NO. : 11/489863
DATED : October 13, 2009
INVENTOR(S) : Williams et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 712 days.

Signed and Sealed this

Fifth Day of October, 2010

David J. Kappos

David J. Kappos
*Director of the United States Patent and Trademark Office*